US012404651B2

(12) United States Patent
Shaposhnick

(10) Patent No.: US 12,404,651 B2
(45) Date of Patent: Sep. 2, 2025

(54) EXCAVATOR BUCKET LOCKING AND SECURITY DEVICE FOR EFFICIENT TRANSPORT

(71) Applicant: Jeff Shaposhnick, Vista, CA (US)

(72) Inventor: Jeff Shaposhnick, Vista, CA (US)

( * ) Notice: Subject to any disclaimer, the term of this patent is extended or adjusted under 35 U.S.C. 154(b) by 822 days.

(21) Appl. No.: 17/561,569

(22) Filed: Dec. 23, 2021

(65) Prior Publication Data

US 2023/0203777 A1 Jun. 29, 2023

(51) Int. Cl.
*E02F 3/36* (2006.01)
*E02F 3/16* (2006.01)

(52) U.S. Cl.
CPC ..... *E02F 3/3622* (2013.01); *E02F 3/16* (2013.01)

(58) Field of Classification Search
CPC ... E02F 3/16; E02F 3/3622; E02F 3/26; E02F 3/265
USPC ..... 37/468
See application file for complete search history.

(56) References Cited

U.S. PATENT DOCUMENTS 3,760,883 A * 9/1973 Birk ..... A01B 59/062 37/231
3,767,070 A * 10/1973 Arnold ..... E02F 3/962 37/406
4,297,074 A * 10/1981 Ballinger ..... E02F 3/3668 37/444
4,452,560 A * 6/1984 Coyle ..... E02F 3/3618 414/723
4,787,811 A * 11/1988 Langenfeld ..... E02F 3/3618 414/723
5,382,110 A * 1/1995 Perotto ..... E02F 3/3663 403/322.3

* cited by examiner

*Primary Examiner* — Christopher J Sebesta
*Assistant Examiner* — Audrey L Lusk
(74) *Attorney, Agent, or Firm* — John R. Ross; John R. Ross, III

(57) ABSTRACT

An excavator bucket locking and security device that is engageable with a backfill blade of an excavator. The locking and security device has a connection device for connection to the excavator bucket. The connection device includes an upper pipe for engaging the bucket's upper receptacles. The connection device also has a lower pipe that is positionable next to the bucket's lower receptacles. An insertable pole is insertable through the lower pipe and through the lower bucket receptacles. The locking and security device also includes a pipe connection device for connecting the upper pipe to the lower pipe. A hook is connected to the pipe connection device. The hook is engageable with a backfill blade of an excavator.

7 Claims, 4 Drawing Sheets

EXCAVATOR BUCKET LOCKING AND SECURITY DEVICE FOR EFFICIENT TRANSPORT

The present invention relates to heavy construction equipment, and in particular, to excavators.

BACKGROUND OF THE INVENTION

Excavators

FIG. 1 shows a prior art excavator. Excavator 1 is used for heavy construction. Excavator 1 includes boom 2, arm 3, bucket 4 and cab 5 positioned on top of rotatable house 6. House 6 sits atop an undercarriage 7 with tracks 8. Excavator 1 also includes backfill blade 10. Backfill blade 10 is a horizontal bulldozer-like blade attached to undercarriage 7. Backfill blade 10 is controllable by the operator sitting inside cab 5. Backfill blade 10 is connected to a connection arm that extends outward from undercarriage 7. Backfill blade 10 may be moved horizontally or vertically by the operator to level or push removed material back into a trench or hole.

Excavator Buckets

FIGS. 2 and 3 show perspective views of prior art excavator bucket 4. FIG. 1 shows excavator bucket 4 pivotally connected to arm 3 of excavator 1 (FIG. 1). Bucket 4 includes bucket teeth 17. Bucket 4 also includes upper receptacles 15 and lower receptacles 16 for receiving a bucket pivot axis and a bucket hydraulic axis, respectively.

Excavator buckets are a major component of an excavator. Excavator buckets are available in a variety of sizes and may be interchanged as appropriate on the end of arm 3. For example, if a narrow trench is needed then it is better to use a narrow bucket. If a wider trench is needed then it is better to use a wider excavator bucket. Therefore, typically the operator will report to a job site with multiple excavator buckets so that he is properly prepared.

Excavator buckets are very heavy. Even the smaller buckets can weigh over 400 pounds each. It can be very time consuming and even dangerous to position multiple buckets at a job site and then remove the buckets when the work day is done or the job is completed. Typically, an operator may attach a bucket to boom 2 with a sling and drive the bucket to a truck for transport. This trip will need to be repeated for multiple buckets, causing significant financial loss due to wasted time. Additionally, an operator will need to hand position the buckets on the transport truck as appropriate. Because the buckets are very heavy, hand positioning of the buckets can cause severe injury to the operator, leading to possible missed work hours and potential worker's compensation claims.

What is needed is a better device and method for maneuvering and transporting excavator buckets.

SUMMARY OF THE INVENTION

The present invention provides an excavator bucket locking and security device that is engageable with a backfill blade of an excavator. The locking and security device has a connection device for connection to the excavator bucket. The connection device includes an upper pipe for engaging the bucket's upper receptacles. The connection device also has a lower pipe that is positionable next to the bucket's lower receptacles. An insertable pole is insertable through the lower pipe and through the lower bucket receptacles. The locking and security device also includes a pipe connection device for connecting the upper pipe to the lower pipe. A hook is connected to the pipe connection device. The hook is engageable with a backfill blade of an excavator. In a preferred embodiment, multiple buckets may be easily transported simultaneously while utilizing the present invention.

DETAILED DESCRIPTION OF THE PREFERRED EMBODIMENTS

Figure 1:
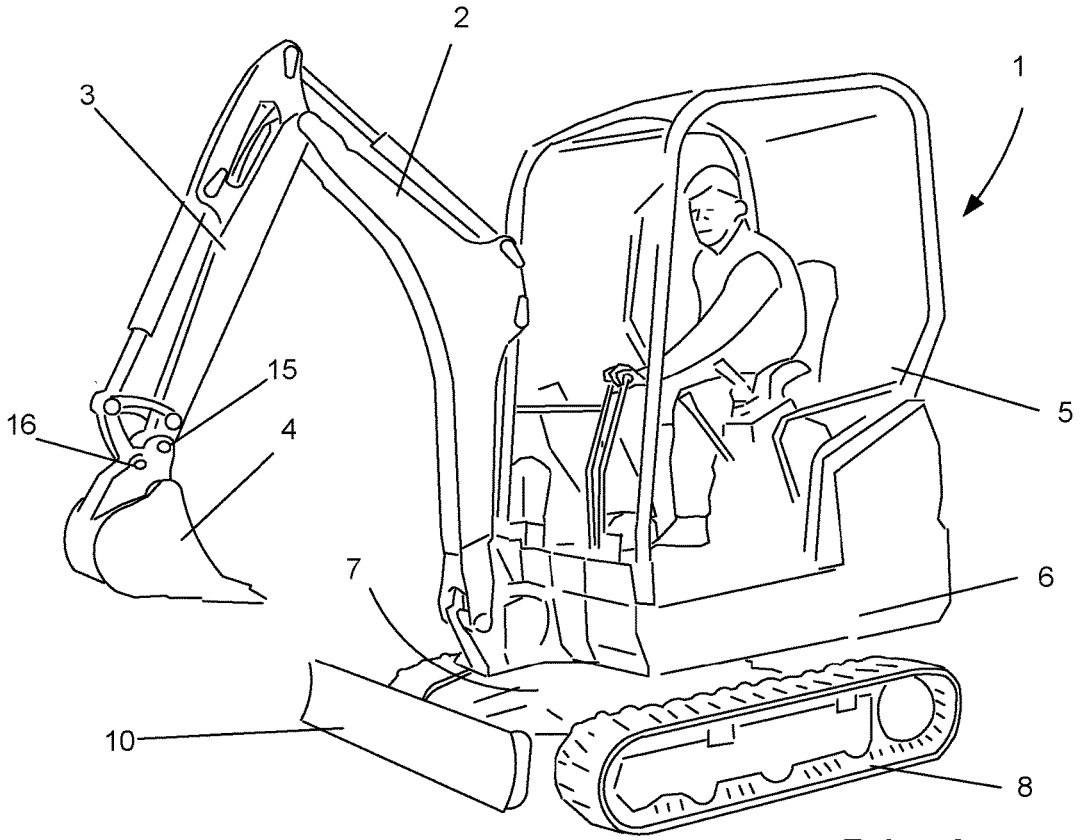
Prior Art FIG. 1
FIG. 1 shows a prior art excavator.
Figure 2:
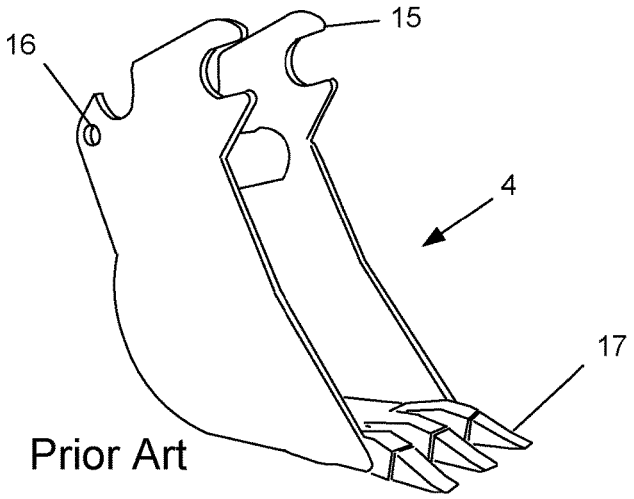
Prior Art FIG. 2
FIGS. 2-3 show a prior art bucket.
Figure 3:
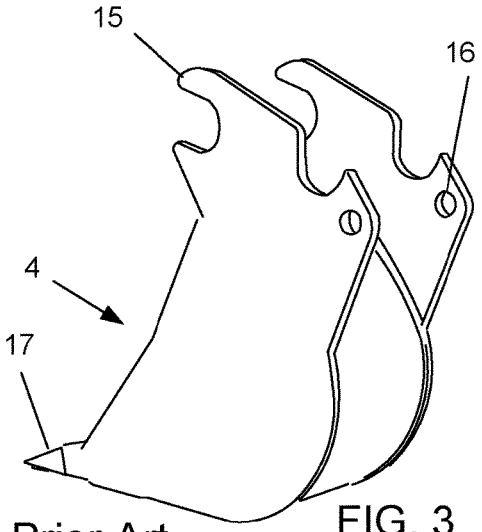
Prior Art FIG. 3
Figure 4:
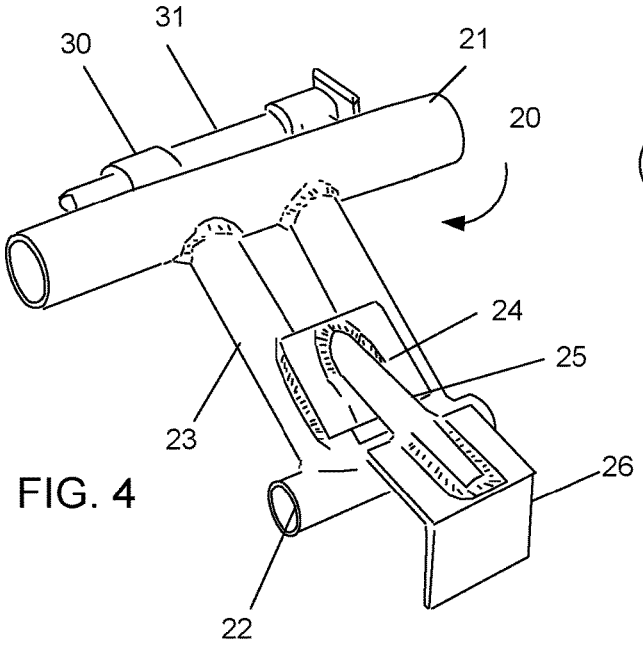
FIGS. 4-5 show a preferred embodiment of the present invention.
Figure 5:
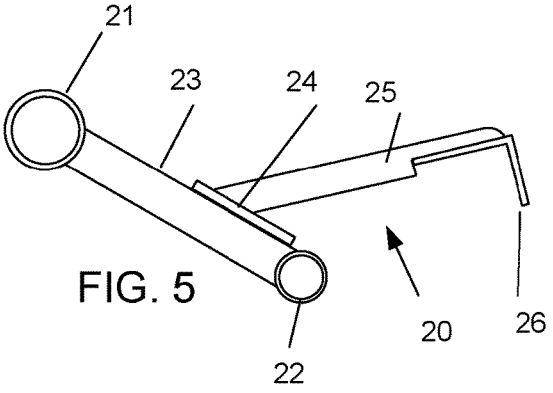

FIG. 4 shows a perspective and FIG. 5 shows a side view of bucket attachment device 20. Bucket attachment device 20 is preferably fabricated from welded steel. Upper pipe 21 is rigidly connected to lower pipe 22 via connection arms 23. Hook attachment plate 24 is rigidly welded to connection arms 23. Hook extension arm 25 is rigidly connected to plate 24 and extends outward from plate 24. Hook 26 is rigidly connected to extension arm 25, as shown. Connector pin holder 30 holding connector pin 31 is rigidly connected to upper pipe 21.

Figure 6:
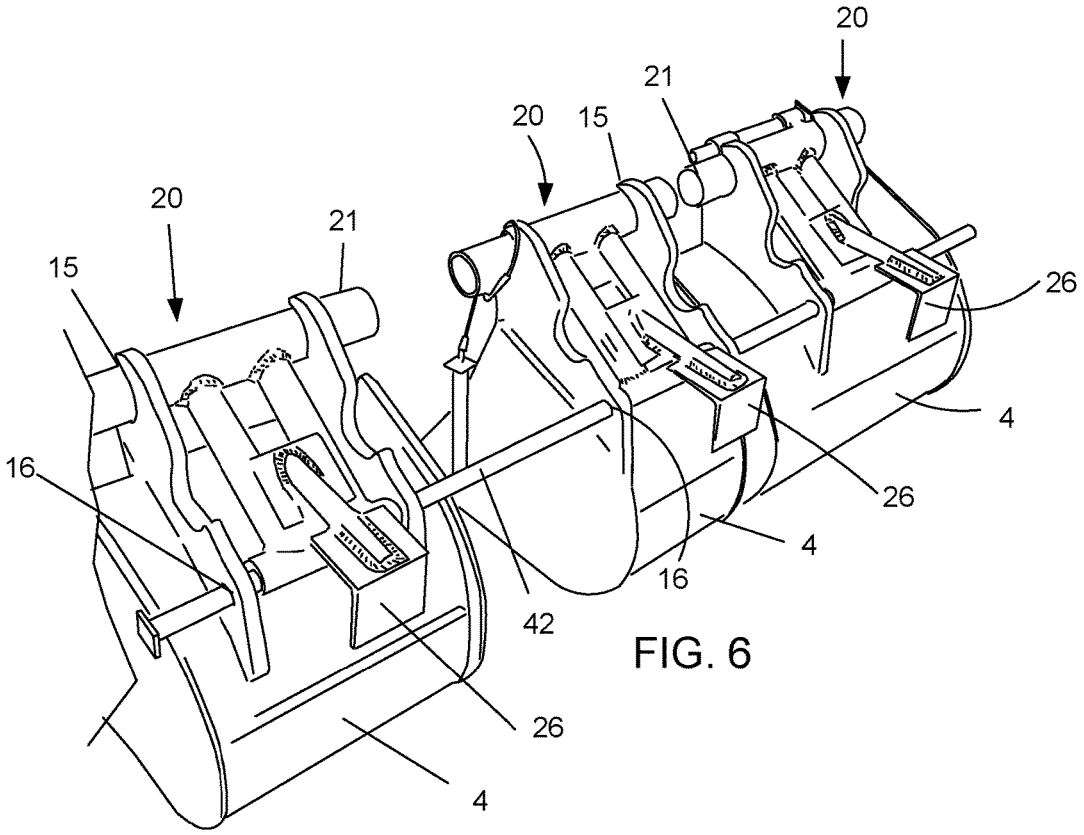
FIG. 6 shows a plurality of buckets in alignment after being connected by utilizing the present invention.

In FIG. 6, the user has rigidly attached three bucket attachment devices 20 to buckets 4. For each bucket, upper pipe 21 is inserted into upper receptacles 15. Extension rod 42 is inserted through lower receptacles 16 and through lower pipes 22. The above-described connection, causes hooks 26 to extend outward and rearward from buckets 4 as shown. It should be noted that buckets 4 (as shown) are of varying widths. Extension rod 42 functions to keep buckets 4 properly aligned so that hooks 26 are arranged in a straight line to properly receive backfill blade 10.

As shown in FIG. 6, a user can now approach hooks 26 with backfill blade 10 and simultaneously lift the buckets and transport them to a desired destination, such as the back of a flatbed transport truck.

Figure 7:
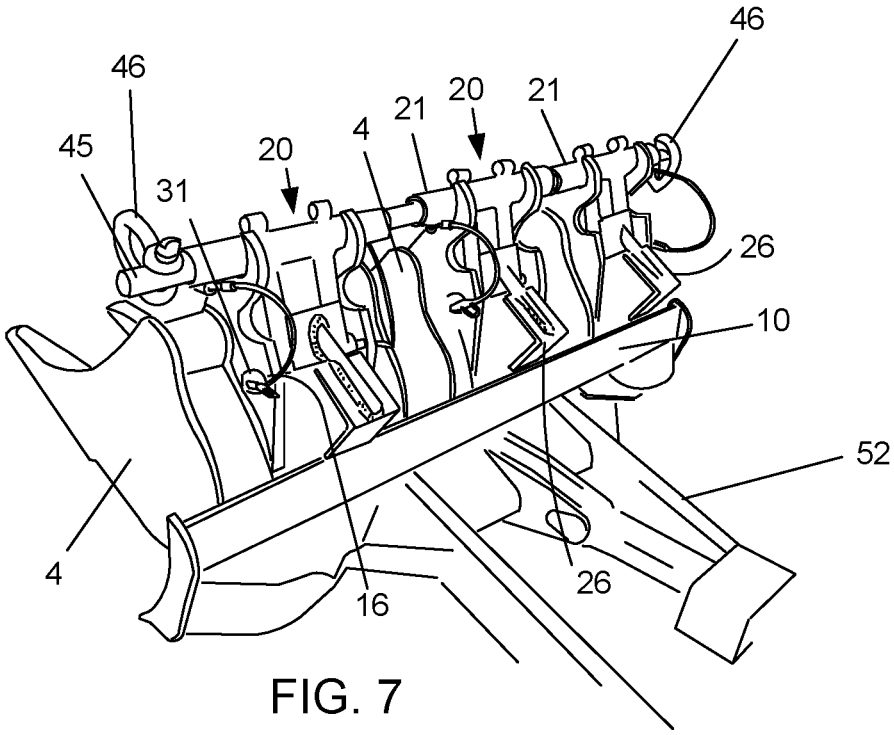
FIG. 7 shows a backfill blade adjacent to a plurality of buckets connected by utilizing the present invention.

FIG. 7 shows another preferred embodiment of the present invention. In FIG. 7, the user has rigidly attached three bucket attachment devices 20 to buckets 4. For each bucket, upper pipe 21 is inserted into upper receptacles 15. Connector pins 31 are inserted through lower receptacles 16 and through lower pipes 22. The above-described connection, causes hooks 26 to extend outward and rearward from buckets 4 as shown. It should be noted that buckets 4 (as shown) are also of varying widths. In the embodiment shown in FIG. 7, the user has extended security pole 45 through upper pipes 21 to secure the buckets adjacent to one another as shown. Security pole 45 is locked at both ends with locks 46. Security pole 45 functions to keep buckets 4 properly aligned so that hooks 26 are arranged in a straight line to properly receive backfill blade 10.

In FIG. 7, the operator of the excavator has moved backfill blade 50 adjacent to the rear of buckets 4 and underneath hooks 26. The operator can now raise backfill blade 10 upwards and transport buckets 4 to a desired location.

Usage of the Bucket Attachment Device

Figure 8:
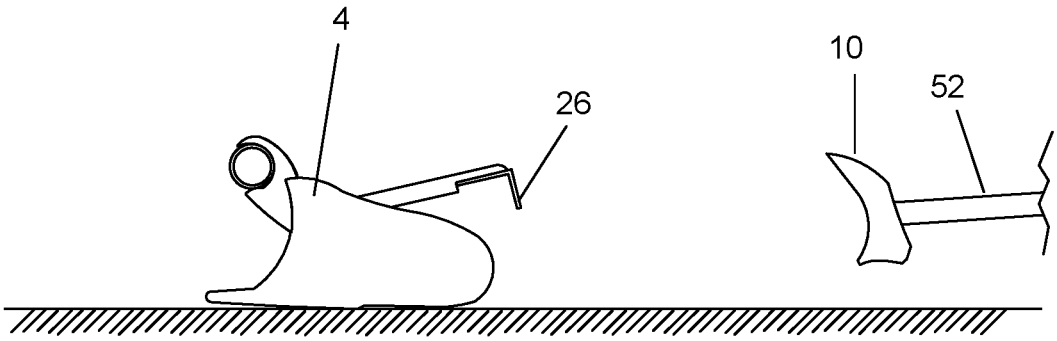
FIGS. 8-13 show a preferred method for utilizing the present invention.

In FIG. 8, the operator is approaching bucket 4 with the excavator. Backfill blade 10 is raised.

Figure 9:
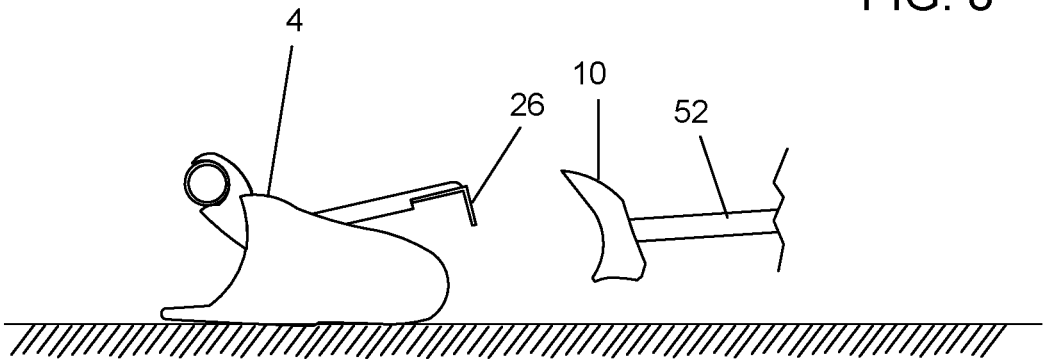

In FIG. 9, the operator has moved closer to bucket 4.

Figure 10:
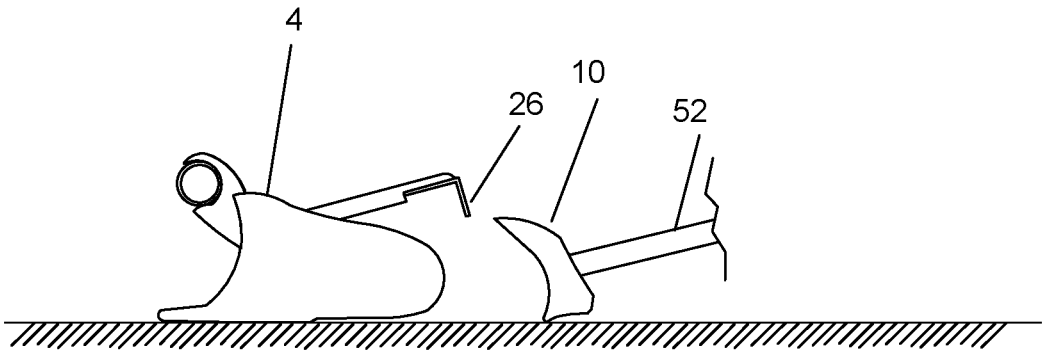

In FIG. 10, the operator has manipulated his controls to move connection arm 52 downward, thereby causing backfill blade 10 to move downward.

Figure 11:
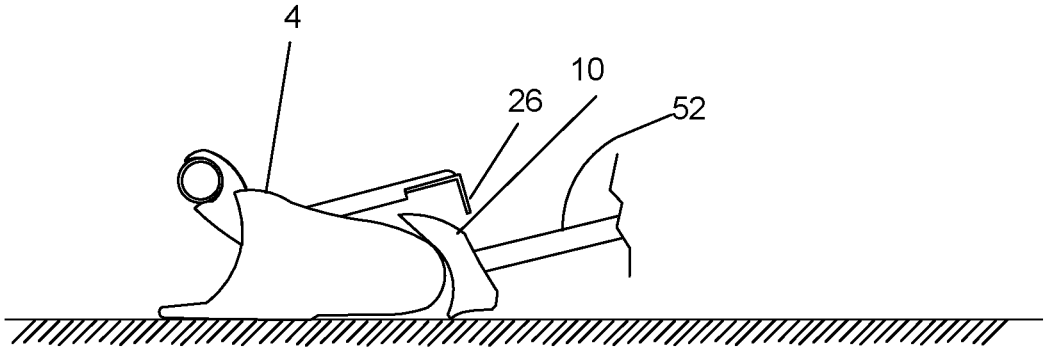

In FIG. 11 the operator has moved backfill blade 10 closer to bucket 4.

Figure 12:
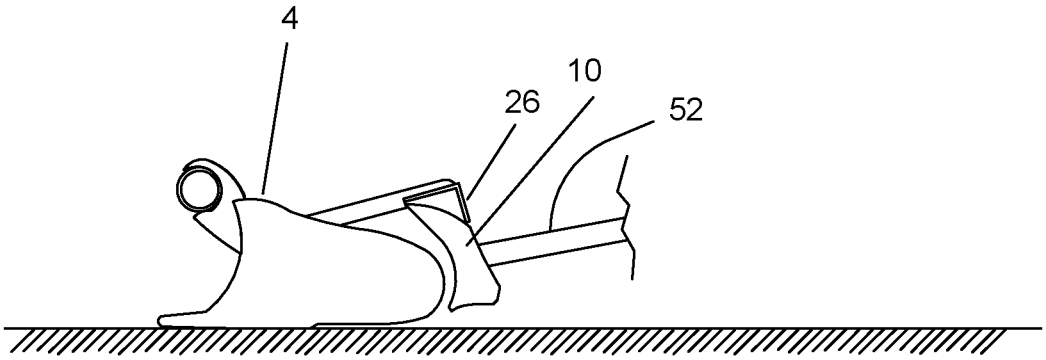

In FIG. 12, the operator has moved backfill blade upwards so that it is engaged with hook 26.

Figure 13:
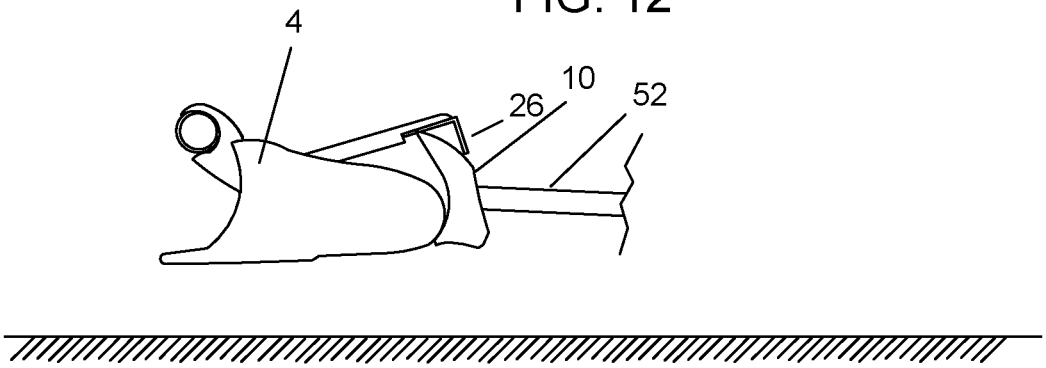

In FIG. 13, the operator has moved backfill blade 10 further upwards, lifting bucket 4 off of the ground. Bucket 4 may now be easily moved to a desired location.

It is to be understood that while certain forms of the present invention have been illustrated and described herein, it is not to be limited to the specific forms or arrangement of parts described and shown. So, the scope of the present invention shall be determined by the appended claims and their equivalents.

What is claimed is:

1. An excavator bucket locking and security device for engagement with a backfill blade of an excavator, said excavator bucket locking and security device comprising:

A. an excavator bucket connection device, comprising:

i. an upper pipe for engaging bucket upper receptacles, ii. a lower pipe positioned adjacent bucket lower receptacles, iii. an insertable pole inserted through said lower pipe and through said bucket lower receptacles, iv. at least one pipe connection device rigidly connecting said upper pipe to said lower pipe, B. a hook rigidly connected to said pipe connection device, wherein said hook is engageable with said backfill blade of said excavator.

2. The excavator bucket locking and security device as in claim 1, wherein said at least one pipe connection device is two pipe connection arms.

3. The excavator bucket locking and security device as in claim 1, further comprising a hook attachment plate rigidly connected to at least one pipe connection device.

4. The excavator bucket locking and security device as in claim 3, further comprising a hook extension arm rigidly connected to said hook attachment plate, wherein said hook is rigidly connected to said hook extension arm.

5. The excavator bucket locking and security device as in claim 1, further comprising a locking pole inserted through said upper pipe and for locking together and aligning multiple excavator buckets.

6. The excavator bucket locking and security device as in claim 1, wherein said insertable pole inserted through said lower pipe and through said bucket lower receptacles is a connector pin for locking one said locking and security device to one said bucket.

7. The excavator bucket locking and security device as in claim 1, wherein said insertable pole inserted through said lower pipe and through said bucket lower receptacles is an extension rod for locking a plurality of said locking and security devices to a plurality of said buckets, and is for aligning said plurality of buckets so that said plurality of buckets are engageable by said backfill blade.

* * * * *